US011098901B2

(12) United States Patent
Okazaki et al.

(10) Patent No.: US 11,098,901 B2
(45) Date of Patent: Aug. 24, 2021

(54) CROSSFIRE TUBE ASSEMBLY WITH INNER TUBE HAVING DIFFERENT CURVATURES

(71) Applicant: Mitsubishi Power, Ltd., Yokohama (JP)

(72) Inventors: Hirofumi Okazaki, Tokyo (JP); Tomomi Koganezawa, Yokohama (JP); Hirokazu Takahashi, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 169 days.

(21) Appl. No.: 16/182,805

(22) Filed: Nov. 7, 2018

(65) Prior Publication Data

US 2019/0137106 A1 May 9, 2019

(30) Foreign Application Priority Data

Nov. 8, 2017 (JP) ..... JP2017-215444

(51) Int. Cl.
*F23R 3/48* (2006.01)
*F23C 6/02* (2006.01)

(52) U.S. Cl.
CPC . *F23R 3/48* (2013.01); *F23C 6/02* (2013.01)

(58) Field of Classification Search
CPC .... F23R 3/48; F23R 3/46; F23R 3/002; F23R 3/60; F23C 6/02
See application file for complete search history.

(56) References Cited

U.S. PATENT DOCUMENTS 6,705,088 B2 * 3/2004 Martling ..... F23R 3/48 60/39.821
6,834,491 B2 * 12/2004 Coppola ..... F23R 3/60 60/39.37
8,220,246 B2 * 7/2012 Widener ..... F23R 3/48 60/39.37

(Continued)

FOREIGN PATENT DOCUMENTS

EP 3 225 917 A1 10/2017
EP 3 306 198 A1 4/2018

(Continued)

OTHER PUBLICATIONS

Extended European Search Report issued in counterpart European Application No. 18204927.0 dated Feb. 4, 2019 (nine (9) pages).

*Primary Examiner* — Todd E Manahan
*Assistant Examiner* — Todd N Jordan
(74) *Attorney, Agent, or Firm* — Crowell & Moring LLP

(57) ABSTRACT

In a gas turbine combustor, a sectional shape in a radial direction of either one of an inner peripheral surface of a second inner tube member and an outer peripheral surface of a first inner tube member, in a fitting portion of a crossfire tube assembly, has a plurality of small-curvature portions having a curvature smaller than a reference curvature, the reference curvature being a curvature of a portion at a maximum distance from the center of the sectional shape. This configuration ensures the crossfire tube assembly is cooled, and the Possibility of thermal deformation or fire damage is lowered, without lowering the temperature of a combustion exhaust gas passing through the crossfire tube assembly of the gas turbine combustor.

11 Claims, 8 Drawing Sheets

(56) References Cited

U.S. PATENT DOCUMENTS

| | | | | |
|---|---|---|---|---|
| 8,813,502 | B2 * | 8/2014 | Ishiguro | F23R 3/283 60/757 |
| 8,959,925 | B2 * | 2/2015 | Romig | F23R 3/48 60/776 |
| 2003/0188537 | A1 | 10/2003 | Martling et al. | |

FOREIGN PATENT DOCUMENTS

| | | | |
|---|---|---|---|
| JP | 11-14056 | A | 1/1999 |
| WO | WO 01/92787 | A1 | 12/2001 |
| WO | WO 2016/036377 | A1 | 3/2016 |

* cited by examiner

CROSSFIRE TUBE ASSEMBLY WITH INNER TUBE HAVING DIFFERENT CURVATURES

BACKGROUND OF THE INVENTION

1. Field of the Invention

The present disclosure relates to a gas turbine combustor, particularly to the structure of a gas turbine combustor which has a plurality of combustors for combustion of a fuel by mixing with air and in which the combustors are connected by a crossfire tube assembly.

2. Description of the Related Art

There is a system called multi-can type gas turbine in which a plurality of can type gas turbine combustors (hereinafter referred to as combustors) are provided for one gas turbine. Normally, the multi-can type gas turbine has a plurality of combustors arranged in an annular pattern around the gas turbine, one or more of the combustors are provided with an ignitor, while the remainder of the combustors have no individual ignitor. For ignition of the combustor having no ignitor, a tubing that connects two combustors adjacent to each other in the gas turbine circumferential direction, called crossfire tube assembly, is used. At the time of starting the gas turbine, a fuel made to flow into the combustor, and the ignitor is started to ignite the combustor which is provided with the ignitor. In the combustor thus ignited, a combustion exhaust gas at a high temperature is generated, resulting in a pressure higher than those inside the adjacent unignited combustors. This pressure difference is utilized to cause the high-temperature combustion exhaust gas to flow into the unignited combustor through the crossfire tube assembly connecting the adjacent combustors, and the combustion exhaust gas serves as an ignition source, whereby the unignited combustor is also ignited. Thus, through the crossfire tube assembly, ignition successively proceeds from the combustor provided with the ignitor to the adjacent combustors, and, finally, ignition in all the combustors is completed. When ignition in all the combustors is completed and the pressure difference between the individual combustors is lost, the flow of the combustion exhaust gas through the crossfire tube assembly ceases.

In general, the crossfire tube assembly is composed of a double tube including an inner tube and an outer tube. The inner tube connects combustion chambers of the adjacent combustors, and plays the role of making the high-temperature combustion exhaust gas to flow in the inside of the combustion chambers, thereby effecting flame propagation. The outer tube is provided on the outer periphery side of the inner tube, and connects combustion air flow passages of the adjacent combustors. With the outer tube provided, the pressure difference between the inside and the outside of the inner tube is reduced, whereby the inner tube is protected.

The crossfire tube assembly is a component part needed for the ignition operation, and, at the time of ignition, the high-temperature combustion gas should be made to flow through the inner tube, thereby securely performing ignition. On the other hand, since the inner tube is exposed to the high-temperature combustion exhaust gas, investigation of prevention of thermal deformation or fire damage should be made. In an ideal situation, after the temporary flow of the high-temperature combustion exhaust gas through the inner tube at the time of ignition, the pressure difference between the combustors would be eliminated and the combustion exhaust gas would not flow through the inner tube. In practice, however, a slight Pressure difference may be generated between the adjacent combustors, and the combustion exhaust gas may continue to flow through the inner tube. Therefore, cooling of the inner tube should be investigated, in order that the heat of the combustion exhaust gas will not influence ignition.

In addition, an investigation for coping with assembleability and deformation at the time of connecting the crossfire tube assembly between the combustors should be made. In the multi-can type gas turbine, generally, the combustors are disposed around a compressor at an inclination relative to a driving shaft, for shortening the length of the driving shaft. The distance between the adjacent combustors is comparatively short, and the crossfire tube assembly should be disposed in a comparatively narrow space surrounded by partition walls of the adjacent combustors. Besides, during operation, the partition walls constituting the combustors undergo thermal expansion due to a rise in the temperature thereof. Therefore, the combustor not only moves in the driving shaft direction but also moves in the radial direction of the driving shaft, so that the adjacent combustors are spaced away from each other by thermal expansion. As a result, the crossfire tube assembly connecting the adjacent combustors is extended in the axial direction. Coping with the deformation, such as provision of the crossfire tube assembly with extensibility in the axial direction should be made.

The related art concerning the cooling, assembleability and deformation problems of the crossfire tube assembly is described, for example, in JP-1999-14056-A and U.S. Pat. No. 6,705,088. According to JP-1999-14056-A, for cooling of a crossfire tube assembly, an inner tube is provided with air holes, and combustion air flowing within an outer tube is made to flow through the air holes into the inner tube, so as to cool the inner tube. In addition, the patent document proposes a method in which the inner tube is divided to provide a fitting portion of a telescopic structure at an intermediate portion of the crossfire tube assembly, in an attempt to cope with assembleability and deformation. By providing the telescopic structure and thereby making the length of the crossfire tube assembly variable in the axial direction, assembleability onto the combustors is enhanced, and thermal deformation is coped with. U.S. Pat. No. 6,705,088 presents a method in which the fitting portion of the inner tube is provided with channels, and combustion air is made to flow through the channels into the inner tube, thereby accelerating cooling of the fitting portion.

SUMMARY OF THE INVENTION

As described in the prior art documents, as a method for facilitating connection of the crossfire tube assembly between the combustors and coping with deformation, there is the method in which the inner tube is divided and the fitting portion of a telescopic structure is provided. In this method, the inside diameter of the inner tube on one side is set slightly larger than the outside diameter of the inner tube on the other side, and the inner tubes are combined with each other. In this instance, the dimensional difference between the inner tubes provide a gap, whereby is possible to flexibly cope with extension of the inner tube and with bending stress. In addition, combustion air (hereinafter referred to air) is made to flow through the gap at the fitting portion, whereby the fitting portion can be cooled.

In regard of cooling of the fitting portion, ideally, it is desirable to dispose the two inner tubes at the fitting portion concentrically, to form an annular gap therebetween, thereby permitting air to flow evenly. By the flow of air, the fitting portion can be cooled evenly in the circumferential direction. In addition, after passing through the fitting portion, the air flows along the inner tube on the downstream side of the fitting portion, resulting in a state of so-called film cooling such as to Protect the partition wall of the inner tube from the high-temperature combustion exhaust gas which flows through a central portion of the inner tube. The film cooling is high in cooling efficiency, whereby a wide range of the inner tube can be cooled with a smaller quantity of air.

In practice, however, the gap in the fitting portion is not always formed in a concentric shape. In many cases, a part where the two inner tubes contact with each other is formed in the fitting portion, so that the gap in the fitting portion is nonuniform. At the part where the two inner tubes contact with each other and the gap is eliminated, air does not flow and, therefore, temperature rises. In addition, in the surroundings of the part, also, a region of slight gap (for example, a gap of less than 0.3 mm) spreads. At the part where the gap is slight, air flow velocity is lowered due to viscosity of air, so that the cooling effect of air is lowered. Therefore, the temperature of the inner tube rises in a wide range centering on the part where the two inner tubes contact with each other, and the possibility of thermal deformation or fire damage is raised.

Meanwhile, on the wall surface of the inner tube, air flow velocity is zero due to the viscosity of air, and flow velocity increases in going away from the wall surface. Therefore, in the vicinity of the wall surface, an air flow velocity difference is particularly enlarged, and disturbance of air is enlarged. In other words, air is disturbed more easily as the surface area of the wall surface of the air flow passage increases, or, in other words, air is disturbed more easily as the length of wall surface appearing on the air flow passage side in a section increases.

As a method for securing a gap at the fitting portion, U.S. Pat. No. 6,705,088 presents a method in which channels are provided on one side or both side of the inner tubes at the fitting portion. In the case of this method, a gap through which air flows is secured by the provision of the channels, but, since the length of the wall surface in the radial-direction section (or a section perpendicular to the axial direction) of the inner tube is increased due to the channels, disturbance of air is increased as compared to the case where the channels are absent. Although a cooling-promoting effect is expected due to the increased disturbance of air at the fitting portion, mixing of air with the high-temperature combustion exhaust gas is promoted due to the increased disturbance of air on the downstream side of the fitting portion. In other words, on the downstream side of the fitting portion, the effect of protecting the inner tube by the film cooling is reduced, and the temperature of the combustion exhaust gas is lowered. In addition, the method of providing the channels leads to complication of a flow passage structure and to a rise in processing cost.

Thus, there is a need to cool a crossfire tube assembly for gas turbine combustors and to lower the possibility of thermal deformation or fire damage, without lowering the temperature of a combustion exhaust gas passing through the crossfire tube assembly.

In accordance with an aspect of the present disclosure, there is provided a gas turbine combustor including: a plurality of combustors each including a Partition wall constituting a combustion chamber, and an outer peripheral partition wall provided at an outer Periphery of the partition wall and defining a combustion air flow passage between itself and the partition wall; and a crossfire tube assembly connecting adjacent ones of the plurality of combustors, the crossfire tube assembly including an inner tube that connects the partition walls of the adjacent combustors, and an outer tube that is provided at an outer periphery of the inner tube and connects the outer peripheral partition walls of the adjacent combustors, the inner tube being divided in an axial direction into a first inner tube member and a second inner tube member, an end portion of the second inner tube member on the first inner tube member side having an enlarged portion that has an inside diameter greater than an outside diameter of the first inner tube member, and the first inner tube member and the second inner tube member forming a fitting portion such that part of the first inner tube member is located on an inner periphery side of the enlarged portion of the second inner tube member with a gap therebetween. In the gas turbine combustor, a sectional shape in a radial direction of either an inner peripheral surface of the second inner tube member or an outer peripheral surface of the first inner tube member at the fitting portion has a plurality of small-curvature portions having a curvature smaller than a reference curvature, the reference curvature being a curvature of a portion at a maximum distance from a center of the sectional shape.

ADVANTAGE OF THE INVENTION

According to the described aspect of the present disclosure, mixing of air and the high-temperature combustion exhaust gas flowing through a central portion of the inner tube is restrained; therefore, a cooling effect on the downstream side of the fitting portion is enhanced, and the possibility of thermal deformation or fire damage of the inner tube of the crossfire tube assembly can be lowered.

DESCRIPTION OF THE PREFERRED EMBODIMENTS

Figure 1:
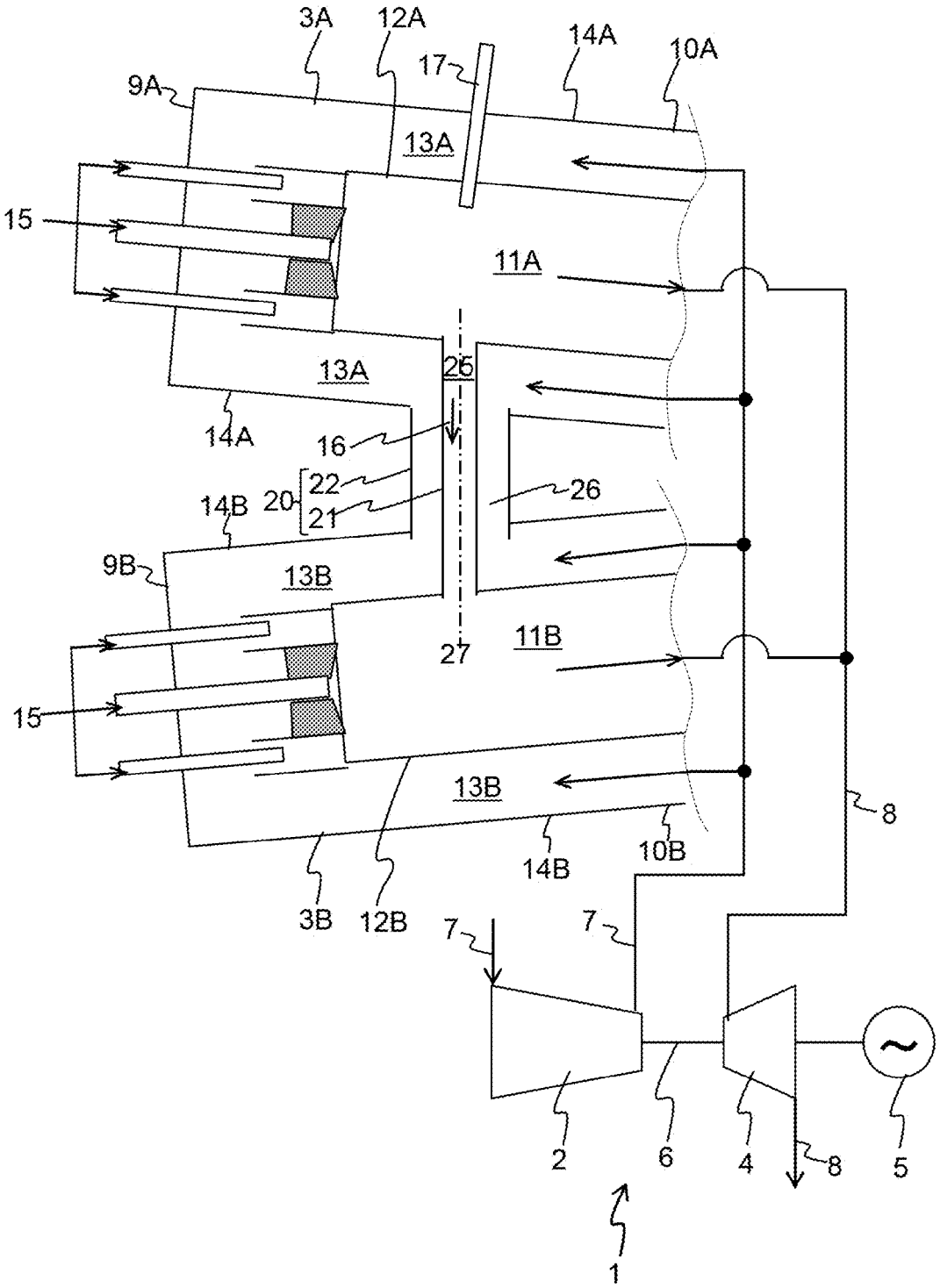
FIG. 1 is a schematic view of a combustor according to a first embodiment of the present disclosure.

Gas turbines as embodiments of the present disclosure will be described below, referring to the drawings. Note that in the following description, the same component parts will be denoted $b_Y$=the same reference characters, and descriptions thereof may be omitted.

First Embodiment

Figure 2:
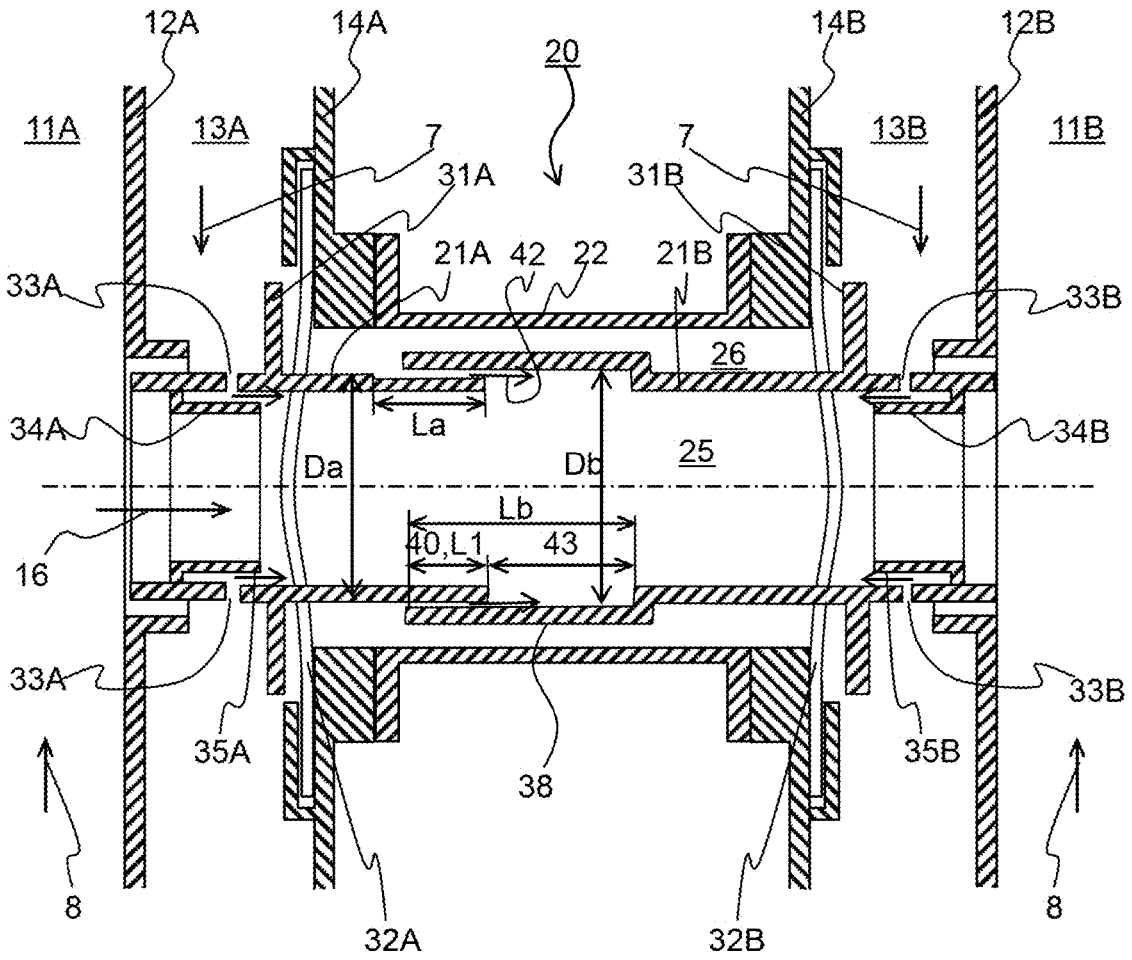
FIG. 2 is a schematic view of a part of a crossfire tube assembly 20 of the combustor shown in FIG. 1.
Figure 3A:
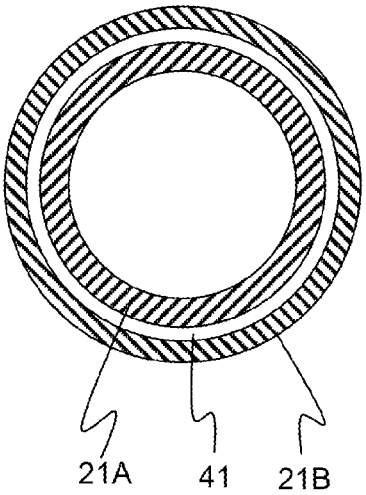
PRIOR ART FIG. 3A
FIGS. 3A and 3B are schematic views of a section of a fitting portion of a crossfire tube assembly according to the related art.
Figure 3B:
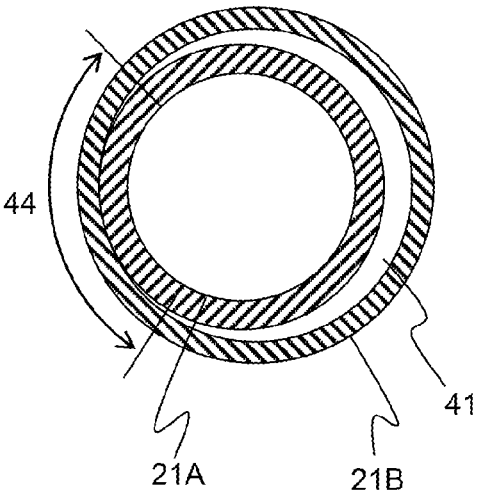
Figure 4A:
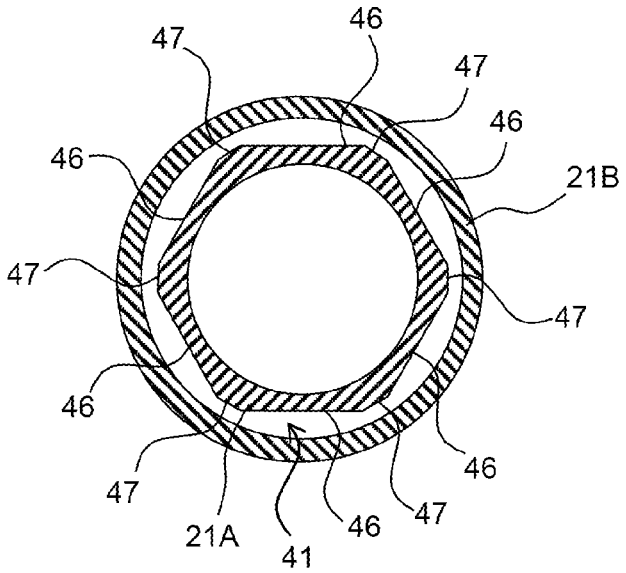
FIGS. 4A to 4C are schematic views of a section of a fitting portion 40 of the crossfire tube assembly 20 shown in FIG. 2.
Figure 4B:
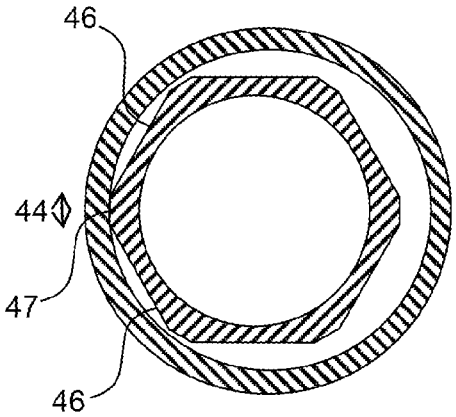
Figure 4C:
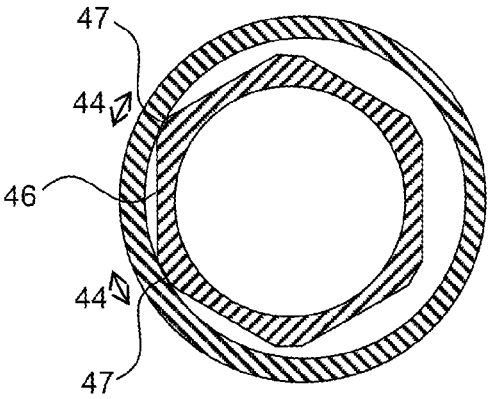

A gas turbine according to a first embodiment of the present disclosure will be described referring to FIGS. 1 to 4. FIG. 1 is a schematic view centering on combustor parts of the gas turbine according to the first embodiment. FIG. 2 is a partial enlarged view of a crossfire tube assembly that connects the combustor parts of FIG. 1. FIGS. 3A and 3B are sectional views of a fitting portion of a crossfire tube assembly according to the related art. FIGS. 4A to 4C are sectional views of a fitting portion of the crossfire tube assembly in the first embodiment, describing correspondingly to FIGS. 3A and 3B. First, based on FIGS. 1 and 2, an outline of a gas turbine combustor and the role and problems of a crossfire tube assembly will be described. Then, based on FIGS. 3A to 4C, the difference between the related art example and the first embodiment of the present disclosure will be described.

In FIG. 1, a gas turbine 1 includes a compressor 2 adapted to compress combustion air 7, a plurality of combustors 3A and 3B adapted to perform combustion of a fuel with compressed air to generate a combustion exhaust gas 8, a turbine 4 driven by the combustion exhaust gas 8 generated by the combustors 3A and 3B, and a generator 5 driven by the turbine 4. A driving shaft 6 connects the compressor 2, the turbine 4 and the generator 5. Air (combustion air) 7 is compressed to a high pressure by the compressor 2, and is mixed with a fuel 15 in the combustors 3A and 3B, to perform combustion. The combustion exhaust gas 8 at a high temperature and a high pressure generated in the combustors 3A and 3B rotates the turbine 4, and a rotational energy of the turbine 4 is converted into electric power by the generator 5. The combustors 3A and 3B are disposed such that their head portions 9A and 9B are located on the compressor 2 side, and their tail portions 10A and 10B are located on the turbine 4 side.

In general, the combustors 3A and 3B are composed of a plurality of multi-can type gas turbine combustors located between the compressor 2 and the turbine 4 and disposed in an annular pattern around the compressor 2 or the driving shaft 6. FIG. 1 shows schematically only two of the combustors. The two combustors 3A, 3B include combustion chambers 11A, 11B, partition walls (liners) 12A, 12B constituting the combustion chambers 11A, 11B, combustion air flow passages 13A, 13B through which combustion air 7 flows, and outer peripheral partition walls 14A, 14B defining the combustion air flow passages 13A, 13B between themselves and the partition walls 12A, 12B. These components 11, 12, 13 and 14 are disposed in the above-mentioned order from the center of each of the combustors 3A and 3B toward a radially outer side. The combustion air (compressed air) 7 discharged from the compressor 2 has its flow direction reversed at the combustor tail portions 10A and 10B, passes through the combustion air flow passages 13A and 13B, and flows to the combustor head portions 9A and 9B. The combustion air 7 has its flow direction reversed again at the combustor head portions 9A and 9B, and mixes in combustion chambers 11A and 11B with the fuel 15 externally supplied at the combustor head portions 9A and 9B, to perform combustion, forming the combustion exhaust gas 8. The combustion exhaust gas 8 flows from the combustor tail portions 10A and 10B into the turbine 4.

Note that while a case where the number of the combustors is two is shown in FIG. 1 for simplification of explanation, the same applies also to the cases where three or more combustors are provided. In addition, while a case where the compressor 2, the turbine 4 and the generator 5 are connected to the single driving shaft 6 is shown in FIG. 1, the driving shaft can be divided into a plurality of portions. Besides, the rotational energy of the turbine 4 can be used for driving other rotating body than the generator 5.

The gas turbine 1 of FIG. 1 further includes an ignitor 17 provided in the combustor 3A to perform spark discharge in the combustion chamber 11A, and a crossfire tube assembly 20 that connects the partition walls 12A and 12B of the two combustors 3A and 3B adjacent to each other in the circumferential direction of the turbine 4. The crossfire tube assembly 20 is composed of a double tube including an inner tube 21 and an outer tube 22 which is Provided at an outer periphery of the inner tube 21 and covers the inner tube 21 from the outer periphery side. The inner tube 21 is a circular tube that connects the two liners 12A and 12B, and the combustion exhaust gas 16 in the combustion chambers 11A and 11B can flow through a cylindrical space 25 formed inside the inner tube 21. In addition, the outer tube 22 is a circular tube that connects the two outer peripheral partition walls 14A and 14B, and the combustion air 7 can flow through an annular space (combustion air flow passage) 26 formed between the outer tube 22 and the inner tube 21. Note that the pressure inside the annular space (combustion air flow passage) 26 is substantially equal to the pressure inside the combustion air flow passages 13A and 13B, whereas the pressure inside the cylindrical space 25 in the inner tube 21 is substantially equal to the pressure inside the combustion chambers 11A and 11B, and, therefore, the pressure inside the annular space 26 is higher than the pressure inside the cylindrical space 25.

The role of the crossfire tube assembly 20 at the time of ignition of the combustor will be described below.

At the time of ignition of the gas turbine 1, a mixture of the fuel and air in the combustion chamber 11A is ignited by the ignitor 17 disposed in the combustor 3A. While the pressure inside the combustion chamber 11A relatively raised by the generation of the combustion exhaust gas, the pressure inside the combustion chamber 11B is relatively low because ignition is not performed there. Therefore, the combustion exhaust gas 16 at a high temperature is sent from the combustion chamber 11A into the combustion chamber 11B through the inner tube 21 (crossfire tube assembly 20) connecting the combustion chambers 11A and 11B. In the combustion chamber 11B, a mixture of the fuel and air is ignited by the high-temperature combustion exhaust gas 16 flowing into the combustion chamber 11B through the inner tube 21. In this way, the unignited combustor 3 adjacent to the ignited combustor 3 is sequentially ignited through the crossfire tube assembly 20 (inner tube 21), whereby all the combustors 3 can be ignited.

Where the combustors 3 are the same in air amount, fuel flow rate and pressure, there is no pressure difference between the combustors 3 when ignition has been finished in all the combustors 3. In this case, the flow of the high-temperature combustion exhaust gas 16 flowing through the inner tube 21 of the crossfire tube assembly 20 becomes absent, and the time for which the high-temperature combustion exhaust gas 16 flows through the inner tube 21 is limited to a short time at the time of ignition. In practice, however, there may be variability in air amount, fuel flow rate, pressure or combustion state from combustor 3 to combustor 3. In this case, the pressure difference between the adjacent combustors 3A and 3B causes the high-temperature combustion exhaust gas 16 to continue flowing through the inner tube 21. The inner tube 21 is heated by the flow therethrough of the high-temperature combustion exhaust gas 16, to a high temperature. If this state is continued due to long-time operation of the gas turbine, inner tube 21 is liable to be deformed or damaged, and, therefore, the inner tube 21 should be cooled.

FIG. 2 shows details of the crossfire tube assembly 20. FIG. 2 is a partial detailed view of FIG. 1. The inner tube 21 includes structures 31A and 31B for positioning of the inner tube 21, and air holes 33A and 33B. In addition, the inner tube 21 is divided at an intermediate portion in the axial direction thereof into two members, namely, a first inner tube member 21A and a second inner tube member 21B. FIG. 2 particularly shows in detail that the inner tube 21 has a fitting portion 40 that connects the inner tube members 21A and 21B.

As the structures for positioning of the inner tube 21, stoppers 31A and 31B for positioning belong to the inner tube members 21A and 21B, in the case of FIG. 2. The inner tube 21 can be positioned by combining the stoppers 31A and 31B with retainers 32A and 32B that connect the outer peripheral partition walls 14A and 14B of the combustors 3A and 3B. The retainers 32A and 32B are generally elastic bodies, which absorb displacements, if any, upon generation of thermal deformation or vibration during operation of the gas turbine, thereby fixing the inner tube members 21A and 21B to the respective combustors 3A and 3B, while reducing the stress generated in the inner tube members 21A and 21B of the crossfire tube assembly 20.

In addition, along the circumferential direction of side surfaces of the inner tube members 21A and 21B, pluralities of air holes 33A and 33B for introducing part of the combustion air flowing through the annular space 26 into the space 25 inside the inner tube 21 are provided. In the example of FIG. 2, the air holes 33A and 33B are provided such as to be located on the combustion chamber 11A, 11B side of the stoppers 31A, 31B, and are opened in the combustion air flow passages 13A and 13B.

On the radially inner side of the inner tube members 21A and 21B from the positions where the air holes 33A and 33B are provided, guide rings 34A and 34B which are partition walls extending along inside surfaces of the inner tube members 21A and 21B are provided. The guide rings 34A and 34B are cylinders concentric with the inner tube members 21A and 21B, and define annular spaces 26 between themselves and the inner tubes 21. End portions on the combustion chamber 11A, 11B side of the guide rings 34A and 34B in the axial direction are closed ends continuous with the inside surfaces of the inner tube members 21A and 21B, and end portions on the other side are open ends fronting on inside space 25 of the inner tube members 21A and 21B.

With the air holes 33A and 33B thus provided, part of the combustion air stagnating in the annular space 26 inside the outer tube 22 of the crossfire tube assembly 20 flows into the space 25 inside the inner tubes 21 where the pressure is lower, and the partition walls of the inner tube members 21A and 21B can be cooled by this combustion air. In this instance, the combustion air having passed through the air holes 33 flows through the annular flow passages between the guide rings 34A and 34B and the inner tube members 21A and 21B as flows 35A and 35B toward the opening ends of the guide rings 34A and 34B, whereby transfer of heat from the flow 16 of the combustion exhaust gas to the inner tube members 21A and 21B is restrained, and a rise in the temperatures of the inner tube members 21A and 21B can be restrained. Such a cooling system is called film cooling, since the flows 35A and 35B of air are formed in a film (layer) form along the inner peripheral surfaces of the inner tubes 21.

In the first embodiment of the present disclosure, the first inner tube member 21A of the two inner tube members 21A and 21B is connected to the combustion chamber 11A on one side nearer to itself, while the second inner tube member 21B on the other side is similarly connected to the combustion chamber 11B on the other side, and end surfaces of the opposite sides of the inner tube members 21A and 21B form the fitting portion 40 at a substantially central portion between the two combustion chambers 11A and 11B. An end portion (the left end portion in FIG. 2) of the second inner tube member 21B on the first inner tube member 21A side has an enlarged outside diameter portion 38 having an inside diameter Db greater than an outside diameter Da of the first inner tube member 21A. In the present embodiment, the first inner tube member 21A and the second inner tube member 21B are combined together at the fitting portion 40 such that part of the first inner tube member 21A is located on the inner periphery side of the enlarged outside diameter portion 38 of the second inner tube member 21B, with a gap therebetween (in other words, such as to form a so-called telescopic structure). With the fitting portion 40 formed in the telescopic structure, extensibility of the crossfire tube assembly 20 in the axial direction is secured, and it is possible to flexibly cope with thermal deformation in a bending direction. In addition, like in the case of the above-mentioned air holes 33A and 33B, the vicinity of the fitting portion 40 can be cooled by taking in the combustion air 42 from the annular space 26 to the fitting portion 40 and causing the combustion air 42 to flow through the gap 41. In this instance, a flow 42 of the air passing through the gap between the two inner tube members 21A and 21B combined together at the fitting portion 40 passes along the inner peripheral surface of the second inner tube member 21B, whereby the aforementioned film cooling effect can be obtained. By the flow 42 of the combustion air from the fitting portion 40, not only the fitting portion 40 but also the portion (enlarge inside diameter portion) 43 obtained by excluding the fitting portion 40 from the enlarged outside diameter portion 38 of the second inner tube member 21B can be cooled.

FIGS. 3A and 3B show the form of a section of a fitting portion 40 according to the related art. Ideally, as shown in FIG. 3A, it is desirable that the section of the fitting portion 40 has a configuration in which two inner tube members 21A and 21B are disposed concentrically, with a gap 41 formed in an annular shape therebetween. In Practice, however, as depicted in FIG. 3B, the two inner tube members 21A and 21B make contact with each other at some place, resulting in a C shape in which part of the gap 41 is closed.

In the case of FIG. 3B, at the part (contact part) where the two inner tube members 21A and 21B make contact with each other and where the gap is lost, air does not flow and, therefore, temperature rises. In addition, while the gap is gradually enlarged from that at the portion surrounding the contact part in going away from the contact part, a region of minute gap (for example, a gap of less than 0.3 mm) spreads. In the region where the gap is minute, flow velocity is low due to the viscosity of air, and, therefore, the cooling effect of the air is low. For this reason, the temperature of the inner tube 21 rises in a range 44, centering on the contact part, where the air flow velocity is low. This range 44 spreads on one side of the inner tube 21. On the other hand, the combustion air easily flows through a part where the gap 41 between the two inner tube members 21A and 21B is enlarged, and the temperature of the inner tube 21 is low in the vicinity of this part. Since the positions of the two kinds of parts are spaced apart, the temperature difference therebetween will be, for example, 200° C. or higher, which may cause thermal deformation. In addition, in the range 44 where the air flow velocity is low, the possibility of fire damage is raised due to the temperature rise. Further, also on the downstream side of the range 44 and in the vicinity of the inner peripheral surface of the enlarged inside diameter portion 43 (see FIG. 2) near the fitting portion 40 of the second inner tube member 21B, a part where air flows with difficulty may be formed, and, therefore, the possibility of thermal deformation or fire damage may be raised.

The present embodiment proposes a method in which in the case of contact between the inner tube members 21A and 21B at the fitting portion 40, the fitting portion 40 and the partition wall (enlarged inside diameter portion 43) near the fitting portion 40 of the second inner tube member 21B are cooled, to reduce the possibility of thermal deformation or fire damage of the inner tube 21. FIGS. 4A to 4C show sectional views of the fitting portion 40 in the first embodiment of the present disclosure.

Figure 5:
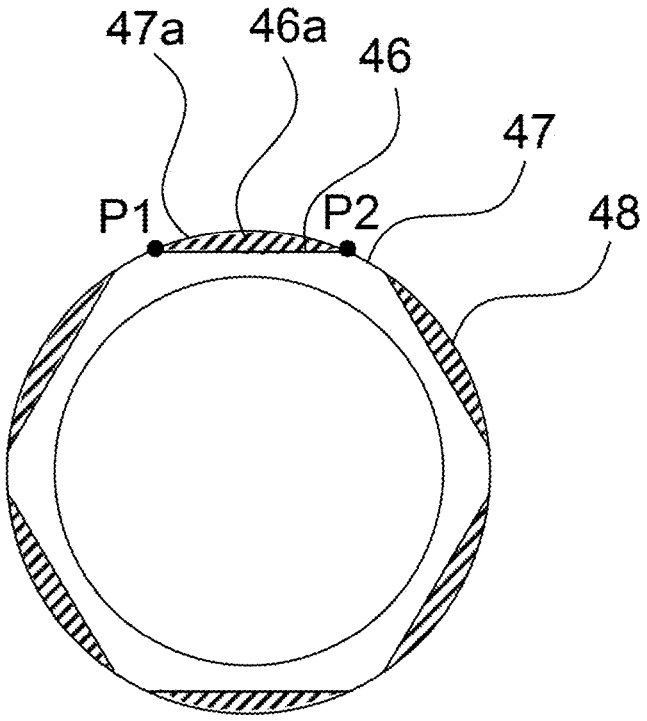
FIG. 5 is an illustration of a method of processing a first inner tube member 21A having a radial-direction section shown in FIGS. 4A to 4C.

In the first embodiment of the present disclosure, a plurality of plain surface portions 46 extending in an axial direction are provided, in a circumferential direction, on an outer peripheral surface of the first inner tube member 21A, near the fitting portion 40. FIGS. 4A to 4C are radial-direction sectional views of the two inner tube members 21A and 21B at the fitting portion 40. In the radial-direction section of the first inner tube member 21A, the sectional shape of the plain surface portion 46 appears as a straight line. FIG. 5 is an illustration of a method of processing the first inner tube member 21A having the radial-direction section shown in FIGS. 4A to 4C. A circular tube 48 of which an outer peripheral surface and an inner peripheral surface are circular in section is prepared, and the outer peripheral surface of an end portion thereof is cut by a predetermined distance along the axial direction, to form plain surface portions 46. In FIG. 5, the portions (cut portions) 46*a* of the circular tube 48 are indicated by slant lines. In FIG. 5, the length of the plain surface portion 46 in the radial-direction section is shorter than the length of a circular arc 47*a* of the cut Portion 46*a* in the radial-direction section (namely, the length of the circular arc of the circular tube 48 before cutting). Therefore, it can be said that the outer circumference length in the radial-direction section of the first inner tube member 21A provided with the plain surface portions 46 by cutting is shortened as compared to the outer circumference length (circumference of circle) of the circular tube 48 before the cutting. In addition, in the Present embodiment, the first inner tube member 21A is formed in such a manner that a spacing is provided between the plain surface portions 46 adjacent to each other in the circumferential direction of the first inner tube member 21A, so that a circular arc portion 47 equal in curvature to the outer peripheral surface of the circular tube 48 appears between the plain surface portions 46 adjacent to each other in the circumferential direction. Note that the curvature is a value showing the degree of bending at each point on a curved surface, and, in the case of the circular arc portion 47 in FIG. 5, the curvature is represented by the reciprocal of the radius (radius of curvature) of the circular arc Portion 47. Besides, the plain surface portion 46 has an infinite radius of curvature which is larger than that of the circular art portion 47, and its curvature that is the reciprocal of the radius of curvature is zero which is smaller than that of the circular arc portion 47 and represents a small-curvature portion.

With the first inner tube member 21A thin provided with the plain surface portions 46 as small-curvature portions, a gap 41 between the two inner tube members 21A and 21B combined with each other at the fitting portion 40 is one of mainly the three types depicted in FIGS. 4A to 4G.

FIG. 4A is a case where the two inner tube members 21A and 21B do not contact with each other at the fitting portion 40; in the figure, a case where both members 21A and 21B are disposed concentrically is particularly depicted. In this case, the inner periphery of the second inner tube member 21B is circular, while the outer periphery of the first inner tube member 21A is a combination of the circular arc portions 47 and the plain surface portions 46 in shape, and, as aforementioned, the outer peripheral surface in the radial-direction section of the first inner tube 21A is shorter in length than the circular tube 48 (see FIG. 5) before formation of the plain surface portions 46.

FIGS. 4B and 4C show cases where the two inner tube members 21A and 21B contact with each other at the fitting Portion 40. FIG. 4B shows a case where the first inner tube member 21A contacts with the second inner tube member 21B at one circular arc portion 47. In this case, the closed part is the one part at the circular arc portion 47, and a C-shaped gap gradually varying in thickness is formed on both sides in the circumferential direction from the one closed Part. FIG. 4C shows a case where the first inner tube member 21A contacts the second inner tube member 21B at two circular arc portions 47. In this case, the closed part is the two parts at the circular arc portions 47, and a gap of which an outer periphery is a circular arc and an inner periphery is a straight line shape of the plain surface portion 46 and a C-shaped gap of which the thickness in the radial direction of the second inner tube member 21B gradually varies in the circumferential direction are formed between the two inner tube members 21A and 21B.

Figure 6:
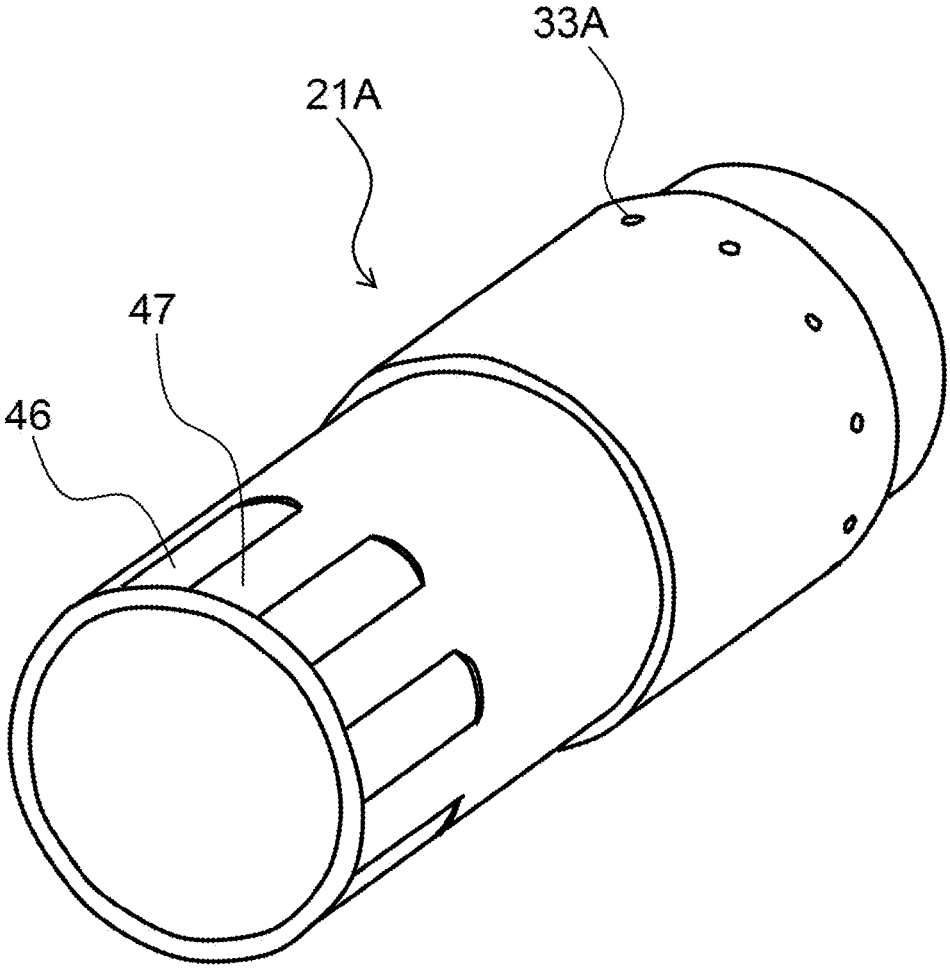
FIG. 6 is a perspective view of an inner tube member 21 in which eight plain surface portions 46 are formed.

Note that as a reference example for permitting easy grasping of the general shape of the first inner tube member 21A, a perspective view of a first inner tube member 21 formed with eight plain surface portions 46 is shown in FIG. 6. The first inner tube members 21A in FIGS. 4A to 5 are provided with six plain surface portions 46, whereas the first inner tube member 21A of FIG. 6 is provided with eight plain surface portions 46, but both of them are the same in other points than this difference, so that the same portions are denoted by the same reference characters. In addition, the stopper 31A is omitted in illustration. As depicted in FIG. 6, a final end of the plain surface portion 46 on the combustion chamber 11A side is raised substantially perpendicularly. It is to be noted, however, that the final end may not necessarily be raised perpendicularly, and may be inclined.

In the present embodiment, when the two inner tube members 21A and 21B contact with each other at the fitting portion 40, the circular arc portion or portions 47 of the first inner tube member 21A on the inner side make contact with the inner periphery of the second inner tube member 21B on the outer side. In this instance, in the vicinity of the Part or parts where the two inner tube members 21A and 21B contact with each other, the plain surface portion 46 formed by cutting the outer peripheral surface of the first inner tube member 21A on the inner side is present, whereby a part or parts are formed where the thickness in the radial direction of the gap between the two inner tube members 21A and 21B is enlarged. The gap part or parts have a sufficient thickness (for example, equal to or more than 0.3 mm), and, therefore, a sufficient air flow velocity is secured, and the inner tubes 21 can be cooled. Thus, a part where a sufficient gap thickness is secured and air cooling progresses is present at a part or parts circumferentially adjacent to the range or ranges 44 where the air flow velocity is low. In addition, the circumferential length of the range or ranges 44 where the air flow velocity is low is reduced as compared to the related art example depicted in FIGS. 3A and 3B. Therefore, the part or parts where the two inner tube members 21A and 21B contact with each other are also cooled by heat conduction of the inner tubes 21, whereby the temperature of the inner tubes 21 is restrained from rising, and the possibility of thermal deformation or fire damage can be lowered. At the enlarged inside diameter Portion 43 near the fitting portion 40 of the second inner tube member 21B, also, the part where air flows with difficulty is reduced as compared to the related art example depicted in FIGS. 3A and 3B, and, as a result, the Possibility of thermal deformation or fire damage is lowered.

—Operation and Effect—

An air flow passage (gap) formed at the fitting portion 40 by the two inner tube members 21A and 21B in the Present embodiment is an annular flow passage which is shaped to be circular on the outer periphery side and be a combination of circular arcs (circular arc portions 47) and plain surfaces (plain surface portions 46) on the inner Periphery side, and of which the thickness in the radial direction gradually varies along the circumferential direction. Here, the sum total of the length of an outer peripheral surface (wall surface) of the first inner tube member 21A and the length of an inner peripheral surface (wall surface) of the second inner tube member 21B, in the radial-direction section of the fitting portion 40, is defined as the "boundary length in section of the gap." The length of the outer peripheral surface of the first inner tube member 21A in the present embodiment is shorter as compared to the case of the circle circumference according to the related art depicted in FIGS. 3A and 3B, due to the provision of the plain surface portions 46. Therefore, the boundary length in section of the gap is shortened as compared to the case of only the circular arc in FIGS. 3A and 3B, by changing part of the circular arc into the plain surface portions 46. For this reason, disturbance of air flowing through the air flow passage (gap) at the fitting Portion 40 is smaller than in the case of the circular annular type in FIGS. 3A and 3B and in the case where the channels described in U.S. Pat. No. 6,705,088 are provided. Therefore, when air having passed through the fitting portion 40 flows in the enlarged inside diameter portion 43 along the inner peripheral surface of the second inner tube member 21B, the disturbance of air is reduced. As a result, mixing between the high-temperature combustion exhaust gas flowing through a central portion of the inner tube 21 and air is restrained, and the air is permitted to reach a region remote from the fitting portion 40. Specifically, a wide range of the inner tube 21 can be protected by the so-called film cooling, so that the cooling effect at the enlarged inside diameter portion 43 on the downstream side of the fitting portion 40 is enhanced, and the possibility of thermal deformation or fire damage of the inner tubes 21 of the crossfire tube assembly 20 can be effectively lowered.

In addition, in the case of the present embodiment, the two inner tube members 21A and 21B are in contact with each other with circular arcs. Therefore, as contrasted to the case where the channels are provided, both members 21A and 21B are not liable to bite each other due to contact or vibration, so that abrasion of them can be reduced.

The enlarged inside diameter portion 43 located in a region on the downstream side of the fitting portion 40 in regard of air flow direction keeps the shape of the inside diameter Db of the second inner tube member 21B equal to that at the fitting portion 40, whereby disturbance of flow 42 of air flowing from the fitting portion 40 into the inner tube 21 is restrained, and the film cooling effect of the combustion air flowing into the fitting portion 40 is made to be easily maintained to the downstream side.

In addition, with the enlarged inside diameter portion 43 provided, the two inner tube members 21A and 21B can slide relative to each other in the axial direction. Therefore, at the time of assembling the combustors 3A and 3B, it is possible, by pushing the first inner tube member 21A into the second inner tube member 21B, to temporarily shorten the whole length of the inner tube 21 in the axial direction, which leads to enhanced assembleability.

The axial length Lb of the enlarged inside diameter portion 43 on the downstream side of the fitting portion 40 is desirably equal to or more than 1.5 times the axial length L1 of the fitting portion 40. This is because it has been found from the experimental results obtained by the Present inventors that the distance over which the effect of film cooling is maintained is about 1.5 times the length L1. In addition, with the length Lb secured, cooling on the second inner tube member 21B side proceeds owing to the flow 42 of air at the fitting portion 40. Therefore, in the case where the inner tube 21 is provided with the air holes 35A and 35B in both end portions thereof, a rise in the temperature of the second inner tube member 21B can be restrained even where the length of the second inner tube member 21B is set larger than the length of the first inner tube member 21A. Accordingly, it is desirable that the length of the second inner tube member 21B is 1.1 to 1.5 times the length of the first inner tube member 21A.

Besides, the axial length La of the plain surface portions 46 of the first inner tube member 21A is preferably larger than the axial length L1 of the fitting portion 40. Such a configuration ensures that an entrance for the flow 42 of air into the fitting portion 40 can be secured on the first inner tube member 21A, and it is easy for air to enter the fitting portion 40. In addition, with the air flowing along the outer surface of the inner tube 21, it is made easy to restrain disturbance of combustion air, and to maintain the film cooling effect to the downstream side. For this reason, it is desirable that the length La of the plain surface portions 46 is equal to or more than 1.1 times the length L1 of the fitting portion 40.

In addition, when the first inner tube member 21A on the inner side of the fitting portion 40 is formed with the plain surface portions 46 such that the radial-direction section thereof is a combination of circular arcs and plain surfaces, the two inner tube members 21A and 21B are in contact with each other with circular arcs, in the case where the two members 21A and 21B become eccentric at the fitting portion 40. Therefore, both members 21A and 21B are not liable to bite each other due to contact or vibration, so that abrasion of them can be reduced.

In the gas turbine combustors and the gas turbine provided with the crossfire tube assembly 20 as above-mentioned, the possibility of thermal deformation or fire damage of the inner tube 21 of the crossfire tube assembly 20 can be effectively lowered. Besides, abrasion at the fitting portion can be reduced. Therefore, the possibility of unexpected trouble or inspection of the combustors is lowered, whereby reliability of operation can be enhanced, and a reduction in operation cost can be realized.

Second Embodiment

While the first inner tube member 21A has been provided with the plain surface portions 46 in the first embodiment, the second inner tube member 21B may be provided with similar plain surface portions. An example of such a case will be described as a second embodiment. Note that the second embodiment is the same as the first embodiment except for the shapes in the radial-direction section of the two inner tube members 21A and 21B in the surroundings of the fitting portion 40, and the description of the same points will be omitted.

Figure 7A:
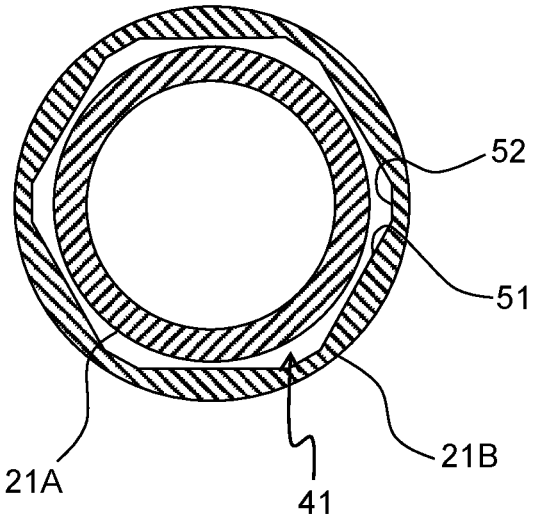
FIGS. 7A to 7C are schematic views of a section of a fitting portion 40 of a crossfire tube assembly 20 according to a second embodiment of the present disclosure.
Figure 7B:
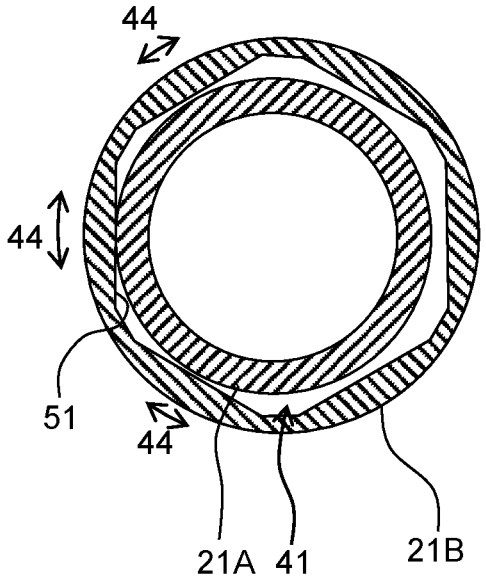
Figure 7C:
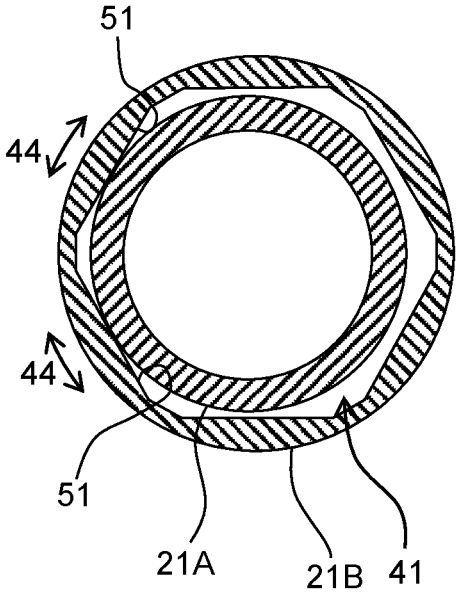

FIGS. 7A to 7C show radiation-direction sectional views of a fitting portion 40 in the second embodiment of the present disclosure. A crossfire tube assembly in the second embodiment has a characteristic in which the inner peripheral surface of the enlarged inside diameter portion 43 of the second inner tube member 21B is provided with a plurality of plain surface portions 51 extending in the axial direction, whereby the inner peripheral surface is roughly polygonal in sectional shape. In addition, in the second embodiment, also, the second inner tube member 21B is formed in such a manner that a spacing is provided between the plain surface portions 51 adjacent to each other in the circumferential direction of the second inner tube member 21B, so that a circular arc portion 52 having the same curvature as that of the inner peripheral surface of the original circular tube appears between the two plain surface portions 51 adjacent to each other in the circumferential direction. With the inner peripheral surface of the second inner tube member 21B formed to be roughly polygonal in sectional shape, the gap between the two inner tube members 21A and 21B combined at the fitting portion 40 is any of three types of shape depicted in FIGS. 7A to 7C.

FIG. 7A is a case where the two inner tube members 21A and 21B do not contact with each other but are disposed concentrically, at the fitting portion 40. In this case, there is formed an annular flow passage which is circular on the inner periphery side and substantially polygonal due to the plain surface portions 51 on the outer periphery side, and in which the thickness in the radial direction of the gap 41 varies gradually in the circumferential direction.

FIGS. 7B and 7C show cases where the two inner tube members 21A and 21B contact with each other at the fitting portion 40. FIG. 7B is a case where the second inner tube member 21B contacts with the first inner tube member 21A at one part of the plain surface portions 51 of the polygonal sectional shape thereof. In this instance, the closed part is three parts where the plain surface portion 51 contacts the first inner tube member 21A, and a C-shaped gap gradually varying in thickness of the gap 41 is formed on both sides of each contact part in regard of the circumferential direction. FIG. 7C is a case where the second inner tube member 21B contacts the first inner tube member 21A at two parts of the plain surface portions 51 of the polygonal sectional shape thereof. In this instance, the closed part is two parts where the plain surface portion 51 contacts the first inner tube member 21A, and a gap of which an inner periphery is a circular arc and an outer Periphery is a straight line shape and a C-shaped gap of which the thickness in the radial direction varies gradually in the circumferential direction are formed between the two inner tube members 21A and 21B.

In the present embodiment, when the two inner tube members 21A and 21B contact with each other at the fitting portion 40, the second inner tube member 21B on the outer side contacts the outer periphery of the first inner tube member 21A at the plain surface portions 51. In this instance, in the vicinity of the contact part, parts where the thickness in the radial direction of the gap is enlarged due to the provision of the plain surface portions 51 of the second inner tube member 21B on the outer side are formed. Since the gap parts have a sufficient thickness (for example, equal to or more than 0.3 mm), a sufficient air flow velocity can be secured, and cooling can be performed. Thus, parts where the thickness of the gap in the radial direction is sufficient and air cooling progresses are present in the vicinity of the range 44 where the air flow velocity is low. In addition, the range 44 where the air flow velocity is low is narrower as compared to the related art example shown in FIGS. 3A and 3B. Therefore, the parts where the two inner tube members 21A and 21B contact with each other are also cooled owing to heat conduction of the inner tubes 21, a rise in the temperature of the inner tubes 21 can be restrained, and the possibility of thermal deformation or fire damage can be lowered. At the enlarged inside diameter portion 43 near the fitting portion 40 of the second inner tube member 21B, also, the part where air flows with difficulty is reduced as compared to the related art example depicted in FIGS. 3A and 3B, and the possibility of thermal deformation or fire damage can be reduced.

—Operation and Effect—

The air flow passage (gap) defined at the fitting Portion 40 by the two inner tube members 21A and 21B in the present embodiment is an annular flow passage which is polygonal in sectional shape due to a combination of the circle on the inner periphery side and the plain surface (plain surface portions 51) and the circular arcs (circular arc portions 52) on the outer periphery side, and of which the thickness in the radial direction gradually varies in the circumferential direction. The "boundary length in section of the gap" is shorter than that in the case where the inner peripheral surface of the second inner tube member 21B is entirely composed of a circular arc, since part of the circular arc in the inner peripheral surface is made to be plain surfaces. Therefore, disturbance of air flowing through the air flow passage (gap) at the fitting portion 40 is smaller than in the case of the circular annular shape depicted in FIGS. 3A and 3B and in the case where the channels described in U.S. Pat. No. 6,705,088 are provided. Therefore, when air having passed through the fitting portion 40 flows in the enlarged inside diameter portion 43 along the inner peripheral surface of the second inner tube member 21B, the disturbance of air is reduced. As a result, mixing between the high-temperature combustion exhaust gas flowing through a central portion of the inner tube 21 and air is restrained, and a wide range of the inner tube 21 can be protected by the so-called film cooling. For this reason, the cooling effect at the enlarged inside diameter portion 43 on the downstream side of the fitting portion 40 is enhanced, and the possibility of thermal deformation or fire damage of the inner tube 21 of the crossfire tube assembly 20 can be effectively lowered, in the same manner as in the first embodiment.

In addition, in the case of the present embodiment, the two inner tube members 21A and 21B are in contact with each other with circular arcs. Therefore, as contrasted to the case where the channels are provided, both members 21A and 21B are not liable to bite each other due to contact or vibration, so that abrasion of them can be reduced.

The enlarged inside diameter portion 43 located in a region on the downstream side of the fitting portion 40 in regard of air flow direction keeps the shape of the inside diameter Db of the second inner tube member 21B equal to that at the fitting portion 40, whereby disturbance of the flow 42 of air flowing from the fitting portion 40 into the inner tube 21 is restrained, and the film cooling effect of the combustion air flowing into the fitting portion 40 made to be easily maintained to the downstream side. In addition, with the enlarged inside diameter portion 43 provided, it is ensured that at the time of assembling the two inner members 21A and 21B into the combustors 3A and 3B, the length of the inner tube 21 can be temporarily shortened, which leads to enhanced assembleability.

The axial length Lb of the enlarged inside diameter portion 43 on the downstream side of the fitting portion 40 is desirably equal to or more than 1.5 times the axial length L1 of the fitting portion 40. This is because it has been found from the experimental results obtained by the present inventors that the distance over which the effect of film cooling is maintained is about 1.5 times the length L1. In addition, with the length Lb secured, cooling on the second inner tube member 21B side proceeds owing to the flow 42 of air at the fitting portion 40. Therefore, in the case where the inner tube 21 is provided with the air holes 35A and 35B in both end portions thereof, a rise in the temperature of the second inner tube member 21B can be restrained even where the length of the second inner tube 21B is set larger than the length of the first inner tube member 21A. Accordingly, it is desirable that length of the second inner tube 21B is 1.1 to 1.5 times the length of the first inner tube member 21A.

In addition, unlike in the first embodiment in which an angular portion present at the boundary between the plain surface portion 46 and the circular arc portion 47 may contact with the inner peripheral surface of the second inner tube member 21B, it is ensured in the second embodiment that the curved surface of the first inner tube member 21A and the plain surface portion 51 of the second inner tube member 21B contact with each other, and, therefore, generation of abrasion can be reduced.

In the gas turbine combustors and the gas turbine provided with the crossfire tube assembly 20 as above-mentioned, the possibility of thermal deformation or fire damage of the inner tube 21 of the crossfire tube assembly 20 can be effectively lowered. Besides, abrasion at the fitting portion can be reduced. Therefore, the possibility of unexpected trouble or inspection of the combustors is lowered, whereby reliability of operation can be enhanced, and a reduction in operation cost can be realized.

Third Embodiment

While the inner tube members 21A and 21B have been formed such that the plain surface portions 46 and 51 being straight lines in sectional shape appear at the fitting portion 40 in the above two embodiments, the shape by which the same effect as in the above embodiments is not limited to a straight line. For example, explaining by use of FIG. 5 in the first embodiment, the sectional shape of the outer peripheral surface of the first inner tube member 21A may not be a straight line (straight line portion 46), and, if it is such a shape that the length of a line connecting two points P1 and P2 is shorter than the circular arc 47*a*, generation of disturbance of air flow can be reduced, and the same effect as in the above embodiments can be obtained. More specifically, a plurality of portions (referred to as small-curvature portions) having a curvature smaller than a curvature KS (referred to as reference curvature KS) at a portion at a maximum distance from a center of a sectional shape in the radial direction of the first inner tube member 21A of the fitting portion 40 may be provided in place of the plain surface portions 46. This point will be described using FIG. 8. Note that herein the curvature of a straight line is considered to zero; for example, the curvature of the plain surface portions 46 in the first embodiment is zero.

Figure 8:
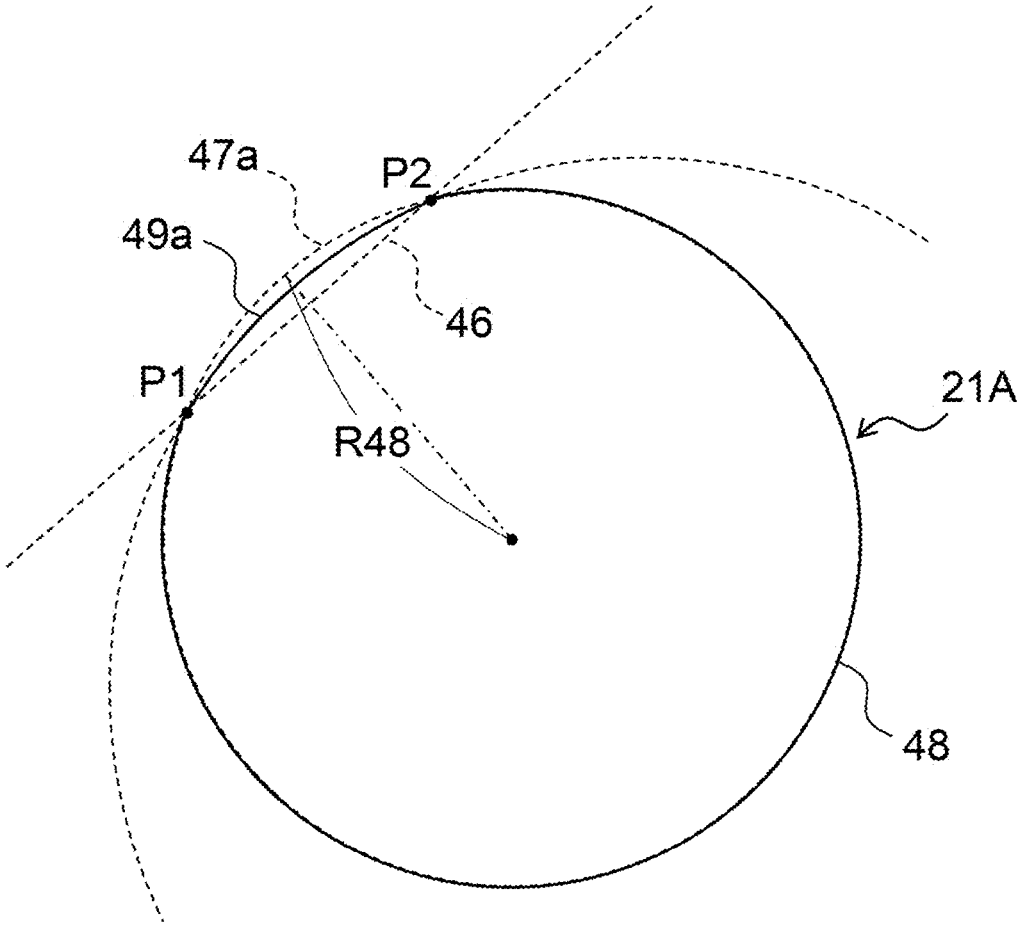
FIG. 8 is an illustration of a small-curvature Portion 49*a* provided in a first inner tube member 21A according to a third embodiment of the present disclosure.

FIG. 8 is an illustration of a small-curvature Portion 49*a* provided in a first inner tube member 21A in a third embodiment. Like FIGS. 4A to 5, FIG. 8 is a radial-direction sectional view of the first inner tube member 21A at the fitting portion 40. In FIG. 8, other portions than the plain surface portion 46 at one part are omitted in illustration, and represented by a circumference of circle. In addition, only the shape of the outer peripheral surface of the inner tube member 21A is illustrated, and the shape of the inside is omitted in illustration. The "portion at a maximum distance from a center of a sectional shape (in the radial direction of the outer peripheral surface of the first inner tube member 21A at the fitting portion 40)" in FIG. 8 is a circular arc portion 47*a* constituting the outer peripheral surface of the original circular tube 48 (FIG. 5), and the reference curvature KS in that instance is a reciprocal of the radius R48 of the circular tube 48.

The first inner tube member 21A in FIG. 8 is provided with the small-curvature portion 49*a*. The two points P1 and P2 in the figure are points at which the plain surface Portion 46 intersects the circumference of circle of the circular tube 48. Here, the curvature of a circular arc or straight line passing through the two points P1 and P2 as the small-curvature portion 49*a* is considered. The curvature of the circular arc 47*a* coincides with the reference curvature KS. The curvature of a circular arc located on the inner side of the circular arc 47*a* decreases below the reference curvature KS as the circular arc 47*a* approaches the straight line 46, and the curvature becomes zero on the straight line 46. Therefore, the small-curvature portion 49*a* having a curvature smaller than the reference curvature KS includes two kinds, one being a circular arc passing between the circular arc 47*a* and the straight line 46, and the other being the straight line (straight line portion 46) in the first embodiment. When the small-curvature portion 49*a* is set in this way, the length of the circular arc or straight line is shorter than the circular arc 47*a*. Therefore, the "boundary length in section of the gap" is shorter in the case where part of the circular arc at the outer peripheral portion of the first inner tube member 21A is made to be the small-curvature portion 49*a* than in the case where the outer peripheral surface is entirely a circular arc. Therefore, disturbance of air flowing through the air flow passage (gap) at the fitting portion 40 is smaller than in the case of the circular annular shape in FIGS. 3A and 3B and in case where the channels described in U.S. Pat. No. 6,705,088 are provided. As a result, in the same manner as in the above embodiments, cooling effect at the enlarged inside diameter portion 43 on the downstream side of the fitting portion 40 is enhanced, and the possibility of thermal deformation or fire damage of the inner tube 21 of the crossfire tube assembly 20 can be lowered.

Note that while a case where the outer peripheral surface of the first inner tube member 21A is provided with the small-curvature portion 49*a* has been described in the present embodiment, the same effect as above can naturally be obtained by providing the inner peripheral surface of the second inner tube member 21B with the small-curvature portions 49*a* in place of the straight line portions 51.

In addition, while the sectional shape of the inner tube member having the plain surface portions 46 or 51 has been a roughly hexagonal shape (an octagonal shape in FIG. 6) in the above embodiments, other polygonal shapes may be adopted. It is to noted, however, that a polygonal shape having an even number of vertices and being symmetrical is preferable, from the viewpoint of even cooling. In addition, the number of vertices is considered to be 10 at most, in consideration of the size of the fitting portion 40 and securing of the gap 41.

Besides, in the first embodiment, the sectional shape of the tubular members may be composed of only the plain surface portions 46 by omitting the circular arc portions 47. This applies also to the second embodiment.

In addition, the present disclosure is not limited to the above-described embodiments, and includes various modifications within the scope of the gist thereof. For example, the present disclosure is not limited to a mode including all the configurations described in the above embodiments, and includes modes in which part of the configurations is omitted. Besides, part of the configuration according to an embodiment may be added to or be replaced by a configuration of other embodiment.

DESCRIPTION OF REFERENCE CHARACTERS

1: Gas turbine
2: Compressor
3A, 3B: Combustor
4: Turbine
5: Generator
6: Driving shaft
7: Combustion air
8: Combustion exhaust gas
9A, 9B: Combustor head portion
10A, 10B: Combustor tail portion
11A, 11B: Combustion chamber
12A, 12B: Partition wall (Liner)
13A, 13B: Combustion air flow passage
14A, 14B: Outer peripheral partition wall
15: Fuel
16: Combustion exhaust gas
17: Ignitor
20: Crossfire tube assembly
21: Inner tube
21A: First inner tube member
21B: Second inner tube member
22: Outer tube
23: Partition wall of inner tube
24, 24A, 24B: flow of air
25: Space inside inner tube
26: Space between inner tube and outer tube
27: center axis of crossfire tube assembly
31A, 31B: Stopper
32A, 32B: Retainer
33A, 33B: Air hole
34A, 34B: Guide ring
35A, 35B: flow of air
38: Enlarged outside diameter portion
40: Fitting portion
41: Gap at fitting portion
42: flow of air
43: Enlarged inside diameter portion of inner tube
44: Range where air flow velocity is low of fitting portion
45: Part where gap is enlarged of fitting portion
46: Plain surface portion
47: Circular arc portion
49*a*: Small-curvature portion
51: Plain surface portion

What is claimed is:

1. A gas turbine combustor comprising:

a plurality of combustors each including a partition wall defining a combustion chamber, and an outer peripheral partition wall surrounding the partition wall and defining a combustion air flow passage between the outer peripheral partition and the partition wall; and a crossfire tube assembly connecting a first combustor of the plurality of combustors to a second combustor of the plurality of combustors, wherein the first combustor is adjacent to the second combustor, the crossfire tube assembly including an inner tube that connects the partition wall of the first combustor and the partition wall of the second combustor, an outer tube that surrounds the inner tube and connects the outer peripheral partition wall of the first combustor and the outer peripheral partition wall of the second combustor, the inner tube being divided in an axial direction into a first inner tube member and a second inner tube member, an end portion of the second inner tube member having an enlarged portion that has an inner diameter greater than an outer diameter of the first inner tube member, and the first inner tube member and the second inner tube member forming a fitting portion such that part of the first inner tube member is located within the enlarged portion of the second inner tube member with a gap therebetween, wherein a sectional shape at the fitting portion in a radial direction of either one of an inner peripheral surface of the second inner tube member or an outer peripheral surface of the first inner tube member has a plurality of small-curvature portions having a curvature than a reference curvature, the reference curvature being a curvature of a portion at a maximum distance from a center of the sectional shape, and wherein the reference curvature is a reciprocal of the maximum distance.

2. The gas turbine combustor according to claim 1, wherein the sectional shape of the small-curvature portions has zero curvature and is a straight line.

3. The gas turbine combustor according to claim 1, wherein the sectional shape of the small-curvature portions has zero curvature and is a straight line, and the sectional shape of the reference curvature is a circular arc.

4. The gas turbine combustor according to claim 2, wherein either the outer peripheral surface of the first inner tube member or the inner peripheral surface of the second inner tube member is provided with a plurality of plain surface portions extending in the axial direction, and wherein the plurality of plain surface portions form the small-curvature portions.

5. The gas turbine combustor according to claim 1, wherein a length of the small-curvature portion in the axial direction is longer than a length of the fitting portion in the axial direction.

6. The gas turbine combustor according to claim 1, wherein a length of the enlarged portion in the axial direction is equal to or more than 1.5 times a length of the fitting portion in the axial direction.

7. The gas turbine combustor according to claim 1, wherein the inner tube is provided with an air hole through which combustion air flowing within a space between the outer tube and the inner tube is introduced into a space inside the inner tube.

8. The gas turbine combustor according to claim 7, comprising a guide ring having a guide wall extending along an inside surface of the inner tube, wherein the guide wall is provided radially inward of the air hole.

9. The gas turbine combustor according to claim 1, wherein the inner tube is connected the outer peripheral partition wall of the first combustor and the outer peripheral partition wall of the second combustor.

10. A gas turbine comprising the gas turbine combustor according to claim 1.

11. A crossfire tube assembly comprising:

an inner tube that connects a partition wall of a first combustor to a partition wall of a second combustor, wherein the first combustor is adjacent to the second combustor, and an outer tube surrounds the inner tube and connects an outer peripheral partition wall of the first combustor and an outer peripheral partition wall of the second combustor, inner tube being divided in an axial direction into a first inner tube member and a second inner tube member, an end portion of the second inner tube member having an enlarged portion that has an inner diameter greater than an outer diameter of the first inner tube member, and the first inner tube member and the second inner tube member forming a fitting portion such that part of the first inner tube member is located within the enlarged portion of the second inner tube member with a gap therebetween, wherein a sectional shape at the fitting portion in a radial direction of either one of an inner peripheral surface of the second inner tube member or an outer peripheral surface of the first inner tube member has a plurality of small-curvature portions having a curvature than a reference curvature, the reference curvature being a curvature of a portion at a maximum distance from a center of the sectional shape, and wherein the reference curvature is a reciprocal of the maximum distance.

* * * * *